US006125929A

United States Patent [19]

Davis et al.

[11] Patent Number: 6,125,929

[45] Date of Patent: Oct. 3, 2000

[54] CASING CUTTER BLADE SUPPORT SLEEVE

[75] Inventors: John Phillip Davis, Cypress; Gerald D. Lynde, Houston, both of Tex.

[73] Assignee: Baker Hughes Incorporated, Houston, Tex.

[21] Appl. No.: 09/088,789

[22] Filed: Jun. 1, 1998

[51] Int. Cl.[7] ..... E21B 29/00

[52] U.S. Cl. ..... 166/55.7; 166/298; 175/320

[58] Field of Search ..... 166/55.7, 55.2, 166/55.8, 298, 241.6, 55.6; 175/320, 325.1

[56] References Cited

U.S. PATENT DOCUMENTS

| | | | |
|---|---|---|---|
| 1,710,580 | 4/1929 | Bus | 166/55.7 |
| 1,814,048 | 7/1931 | Lincoln | 166/55.7 |
| 1,959,284 | 5/1934 | Clark et al. | 166/55.7 |
| 2,803,301 | 8/1957 | Warner et al. | 166/55.7 |
| 4,889,197 | 12/1989 | Boe | 175/267 |
| 5,010,967 | 4/1991 | Desai | 175/406 |
| 5,201,817 | 4/1993 | Hailey | 175/269 |

OTHER PUBLICATIONS

*Tri–State Multi–String Cutters Instruction Manual;* Apr., 1985; pp. 1 through 24.

*Primary Examiner*—Frank S. Tsay
*Attorney, Agent, or Firm*—Gerald W. Spinks

[57] ABSTRACT

A blade support assembly for use with a casing cutter to cut through casing or pipe downhole in a well. A tubular body fits over the casing cutter, with slots aligned with the pivoting cutter blades. Support plates next to each slot provide support for the blades during cutting operations. Torque keys and matching torque slots in the blade support assembly and the casing cutter body transfer torque from the casing cutter body to the blade support assembly, and thence to the blades.

17 Claims, 2 Drawing Sheets

CASING CUTTER BLADE SUPPORT SLEEVE

BACKGROUND OF THE INVENTION

1. Field of the Invention

This invention is in the field of tools used to cut through casing strings installed in a well, such as an oil and gas well, to allow the removal of the casing strings from the well.

2. Background Information

When an oil or gas well is drilled, it is common to install large pipe, or casing, in the hole as it is drilled. Several different diameters may be installed, in fact, in the same hole. Some of the casing strings can be large diameter, up to 20 or 30 inches. Often the casing is cemented together. Where multiple strings are to be cut and removed from the hole, the operator may elect to use a smaller bodied casing cutter tool, along with multiple sets of blades of different lengths, or one set of long blades may be chosen. As a typical example, an 11¾ inch outside diameter tool might be used in cutting multiple strings of casing having diameters of 13⅜ inches, 20 inches, and 30 inches. The blades pivot near the top of the blade, to swing outwardly from the cutter tool. Where one set of long blades is used to make the full cut, the blades must be long enough to reach to the outer casing limits.

Other large diameter pipes are also used in the oil field, such as conductor pipes, or offshore platform legs. These can reach 60 inches in diameter. In cutting these larger diameter pipes, the operator may, again, elect to use a smaller bodied casing cutter tool, along with long blades.

Torque is transferred to the blade only at the top of the blade, where the blade is within the cutter body. This torque imposes an excessive bending stress or shear stress on the blade, because it is unsupported for most of its length, especially when cutting the larger diameter casing or pipe. Often in such a situation, the blade bends or breaks. Being much smaller than the casing diameter, the cutter body tends to wobble from side to side as the cut is being made. This tends to put enormous stresses on the blades, contributing to their failure. Further, when longer blades are used, the blade must be essentially straight, because the blade must fit within the outside diameter of the cutter tool to facilitate running the cutter tool into the hole. This means the blade will have a "sweeping" motion, causing longer blades to contact the casing at shallower angles, requiring the removal of more metal, and taking longer to make the cut.

If the blade bends excessively during the cutting operation, it may not retract fully into the cutter body. If the cutter must be removed from the well prior to completing the cut, the bent blades will not allow the cutter to be withdrawn up into the smaller casing, where present, and the cutter becomes stuck in the hole.

In an effort to strengthen the blades, different materials offering higher strength have been used, but this creates another problem. That is, the blades become more susceptible to weld cracks. The cracks contribute to breaking of the blades, leaving junk in the well, and, of course, not making the cut.

To reduce the tendency of the blades to bend or break, the operator often makes several runs using progressively longer arms. Some have also addressed this problem by simply building several tools with larger outside diameters. This adds to inventory, and still does not provide the ideal tool for torque resistance at the top of the blade. In most cases, the operator will at least add several stabilizers to his bottom hole assembly, to reduce the wobbling of the casing cutter tool.

It would be desirable to have a tool which supports the blade all the way to a position near the inside diameter of the pipe being cut, with the ability to cut several different diameter pipes, without having to stock multiple casing cutters in various tool body diameters.

BRIEF SUMMARY OF THE INVENTION

The present invention is a blade support assembly for use with a casing cutter, and the combination of the casing cutter and the blade support assembly, resulting in a cutter which is more effective on large casing cutting operations, and which can easily be adapted to cut various sizes of casing.

A sleeve assembly is provided for mounting on an existing casing cutter body, with the sleeve assembly fitting over the portion of the cutter tool where the pivoting blades are located. The sleeve assembly consists essentially of a tubular body having longitudinal slots through which the cutter blades can pivot outwardly. The inside diameter of the sleeve body is designed to fit closely over the outside diameter of the cutter body. Torque transfer means, such as keys and matching slots, are provided to transfer torque from the cutter body to the sleeve body. A blade support element, such as a radially extending plate, is provided next to each blade slot, to support the blade during the cutting operation. The outer dimension of the sleeve assembly, which depends upon the radial dimension of the support plates, is designed to fit within the inside diameter of the casing or pipe to be cut. Several sleeve assemblies having a given inside diameter, but having different outer dimensions, can be provided for cutting different diameters of pipe with a single cutter tool. Gussets and support rings can be provided to rigidly support the support plates on the sleeve body.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
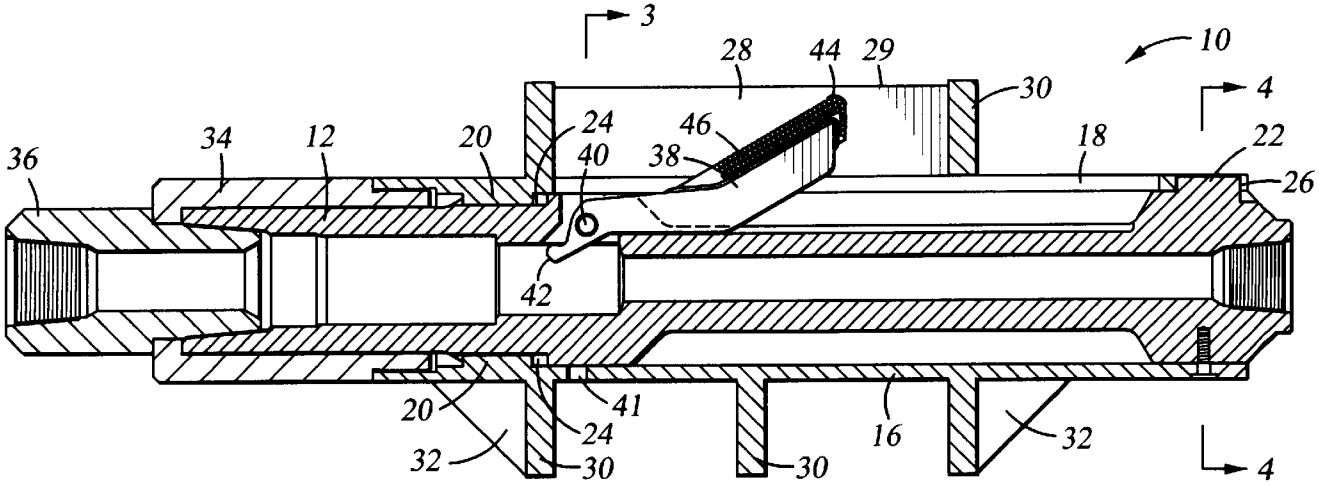
FIG. 1 is a longitudinal section view showing the cutter body and blade support sleeve of the present invention, with the blade in the retracted position.

As shown in FIG. 1, the casing cutter assembly 10 of the present invention includes a casing cutter body 12 and a blade support assembly 14 mounted on the casing cutter body 12. The blade support assembly 14 includes a hollow tubular support body 16, which has an inside diameter sized to fit closely over the outside diameter of the casing cutter body 12. A plurality of longitudinal blade slots 18 are formed through the wall of the support body 16, with only one such blade slot 18 being shown in FIG. 1.

A plurality of torque transfer elements, consisting of torque keys 20, 22, and torque slots 24, 26, are formed on the support body 16 and the casing cutter body 12. Other types of torque transfer elements could be used instead, such as bolts or pins. At least one upper torque key 20 is formed on the inside diameter of the support body 14, projecting radially inwardly. The upper torque key 20 is formed above the level of the longitudinal blade slots 18, with the term "above" referring to the longitudinal position of the upper torque key 20 when the casing cutter assembly 10 is in a vertical orientation in a well bore. If the casing cutter assembly 10 is used in an angled or horizontal portion of a well bore, the term "above" should be understood to refer to the direction closer to the drilling rig. Each upper torque key 20 fits into a matching upper torque slot 24 formed in the outside diameter of the casing cutter body 12.

At least one lower torque key 22 is formed on the outside diameter of the casing cutter body 12, projecting radially outwardly. The lower torque key 22 is formed below the level of the longitudinal blade slots 18, with the term "below" referring to the longitudinal position of the lower torque key 22 when the casing cutter assembly 10 is in a vertical orientation in a well bore. If the casing cutter assembly 10 is used in an angled or horizontal portion of a well bore, the term "below" should be understood to refer to the direction farther from the drilling rig. Each lower torque key 22 fits into a matching lower torque slot 26 formed in the wall of the support body 16. The lower torque slot 26 is shown penetrating the support body 16, but it could be a blind slot. Providing at least one torque transfer element above the level of the longitudinal slots 18 and at least one torque transfer element below the level of the longitudinal slots 18 rigidly attaches the blade support assembly 14 to the casing cutter body 12, more efficiently transferring torque from the casing cutter body 12 to the blade support assembly 14.

A blade support element, such as a blade support plate 28, is attached to the support body 16 next to each longitudinal blade slot 18, extending radially outwardly. Typically, in fact, a blade support plate 28 will be provided on each side of each blade slot 18, to provide a more rigid assembly. However, it may be sufficient in some applications to provide only one blade support plate 28 next to each blade slot 18, with the blade support plate 28 being positioned to follow the blade slot 18 as the cutter assembly 10 rotates. The outer edges 29 of the blade support plates 28 are substantially at the outside diameter of the entire cutter assembly 10, and the outside diameter of the cutter assembly 10 is sized to fit within, but close to, the inside diameter of the pipe or casing to be cut. For instance, if the casing to be cut is a 30 inch casing having a 28 inch inside diameter, the support assembly 14 typically will be built with the outer plate edges 29 located on a 27 inch diameter.

A plurality of annular support rings 30 can be provided encircling the support body 16 to lend additional support to the blade support plates 28. The support rings 30 can be essentially continuous, or segmented. A plurality of gusset plates 32 can also be provided to assist in supporting the blade support plates 28 and annular support rings 30 from the support body 16.

A standard casing cutter body 12 can be modified to accept the blade support assembly 14 of the present invention by welding a plurality of lower torque keys 22 to the lower periphery of the casing cutter body 12, and by milling a plurality of upper torque slots 24 in the upper periphery of the casing cutter body 12. The upper torque keys 20 welded into the inside of the blade support body 16 mate with the upper torque slots 24, and the lower torque slots 26 formed in the blade support body 16 mate with the lower torque keys 22, as the blade support assembly 14 is placed over the cutter body 12. A tubular connector body 34 can be provided to longitudinally position and attach the support assembly 14 to the cutter body 12. The connector body 34 is threaded into the upper end of the blade support assembly 14. Finally, a top sub 36 can be threaded into the upper end of the cutter body 12 and torqued in place, capturing the connector body 34 between the top sub 36 and the cutter body 12.

A plurality of cutter blades 38 are mounted at intervals around the cutter body 12, pivoted about pivot pins 40 near the upper ends 42 of the blades 38. During operation, a selectively actuatable device (not shown), as is known in the art, can be actuated to press downwardly on the upper ends 42 of the blades 38 to pivot the lower blade ends 44 outwardly, when desired by the operator. A plurality of cutting elements 46 can be provided on the leading edges of the blades 38, for cutting the casing or pipe.

With the arrangement of torque transfer elements 20, 22, 24, 26 shown, the blade support assembly 14 can be slipped coaxially over the casing cutter body 12 from its upper end, as the upper torque keys 20 slide into the upper torque slots 24, and the lower torque keys 22 slide into the lower torque slots 26. If the blades 38 extend radially beyond the support body 16 as shown, segmented lower and intermediate annular support rings 30 can be used. In other words, gaps in the lower and intermediate annular support rings 30 can be made sufficiently wide to allow the blade support assembly 14 to pass the extending blades 38. Alternatively, pivot pin access holes 41 can be provided in the support body 16 to allow installation and removal of the pivot pins 40, thereby allowing installation and removal of the blades 38 with the blade support assembly 14 in place.

It should be noted that, with the blade support assembly 14 installed, the blades 38 can extend well beyond the outside diameter of the casing cutter body 12, while still being protected from damage while the tool is being run into a well. Since blades 38 can be used which extend well beyond the casing cutter body 12, but which are still contained with the outside diameter of the casing cutter assembly 10, the radial dimension of the blade can be increased by at least a factor of 200–400%. Two of the most important goals in cutting through casing are to remove the least amount of casing material necessary to make a complete cut, and to do so in the shortest possible time period. Therefore, it is beneficial to orient the outer ends 44 of the blades 38 at a substantial angle relative to the tool axis, as shown in the Figure. With this angled orientation of the blades 38, as the blades 38 are pivoted, they provide more of a "plunging" entry into the casing wall, thereby cutting through the wall more quickly and removing less material. This highly angled blade orientation is made possible by use of the blade support assembly 14 of the present invention.

Figure 5:
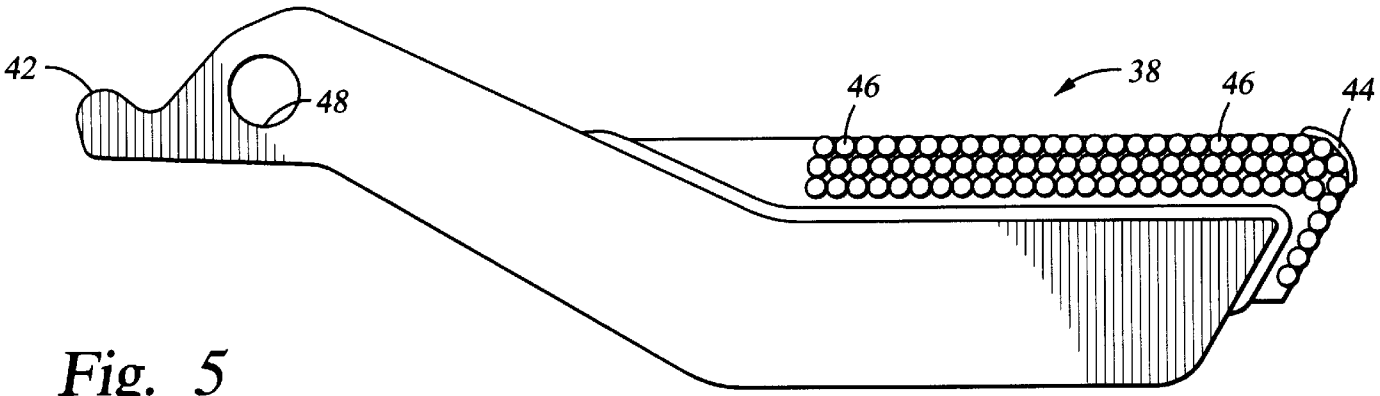
FIG. 5 is a side elevation view of a blade shape which is particularly advantageous for use in the present invention.

A blade 38 which takes advantage of this benefit is shown in FIG. 5. As described above, the blade 38 is pivoted about a pivot pin 40 passing through a pivot hole 48 near the upper end 42 of the blade 38. Any type of actuation mechanism within the casing cutter tool can be actuated to press downwardly on the upper end 42 of the blade 38 to pivot the lower blade end 44 outwardly when desired by the operator. A plurality of cutting elements 46, such as the round inserts shown, are provided on the leading edges of the blade 38, for cutting through the casing or pipe in more of a plunging motion than a sweeping motion. It is not necessary to use this type of blade, however. Other configurations of the blades 38 can be used, as well.

Figure 2:
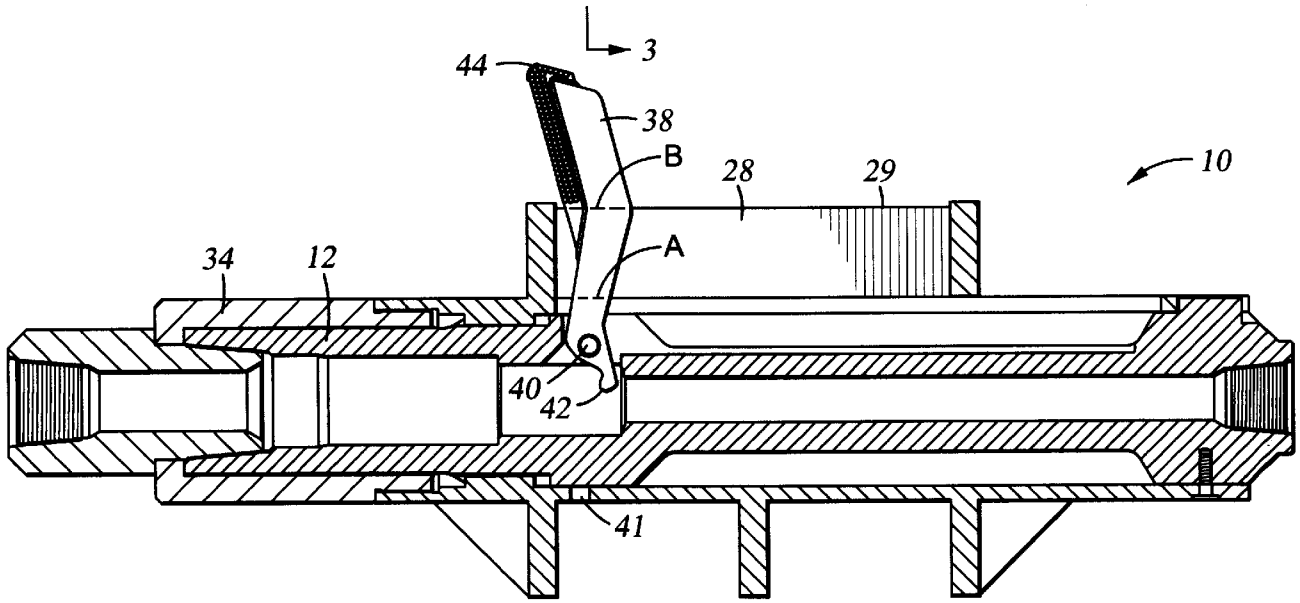
FIG. 2 is a longitudinal section view of the tool shown in FIG. 1, with the blade in the extended position.

Another important goal in casing cutting operations is to avoid bending or breaking of the cutter blades. Referring to FIG. 2, the blades 38 of the tool of the present invention are shown in the maximum extended position. An area from the upper end 42 of the blade 38 to the dashed line A at the outer edge of the cutter body 12 would normally have to transfer the torque applied by the cutter body 12 to the blade 38, if the blade support assembly 14 of the present invention were not used. With the blade support assembly 14 in use, an additional area from the dashed line A to the dashed line B at the outer edge 29 of the blade support plate 28 is now available for torque transfer. It is estimated that a 27 inch o.d. blade support assembly 14, mounted on an 11¾ inch cutter tool, can increase the torque transfer area on each blade 38 fivefold, from approximately 6 square inches to approximately 30½ square inches.

Additionally, the blade support assembly 14 acts like a built in stabilizer to provide a more smooth running operation. This eliminates the need for the operator to add stabilizers to the bottom hole assembly to compensate for the fact that the cutter diameter is so much smaller than the casing inside diameter.

Figure 3:
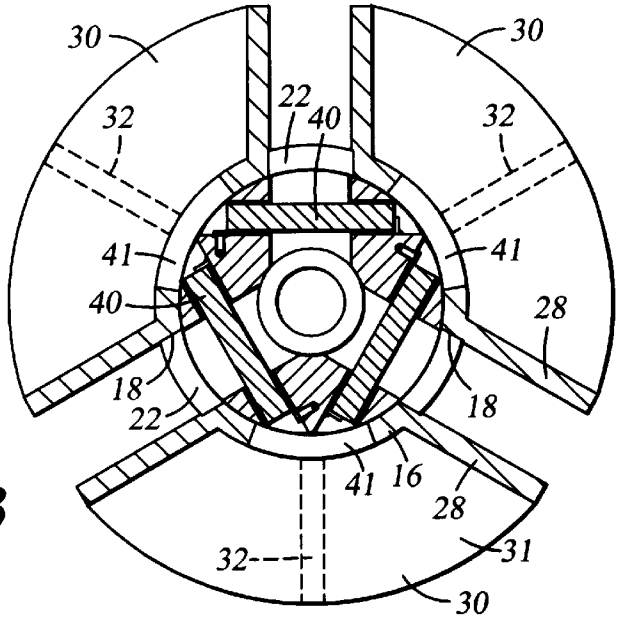
FIG. 3 is a transverse section view of the tool shown in FIG. 1, at the plane of the blade pivot pins.
Figure 4:
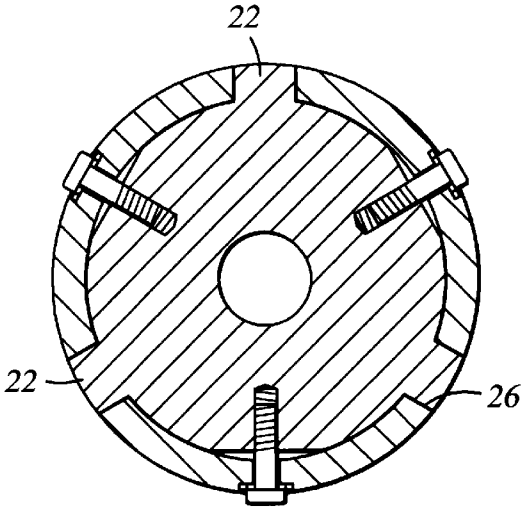
FIG. 4 is a transverse section view of the tool shown in FIG. 1, at the plane of the lower torque transfer elements.

FIG. 3 shows a transverse section of the casing cutter assembly 10 at the level of the pivot pins 40, illustrating how the support plates 28 and support rings 30 leave passages for the blades 38. For clarity, the blades 38 are not shown in this view. A blade support plate 28 is shown on each side of each blade slot 18. A lower torque key 22 is also shown projecting radially outwardly at the lower end of each blade slot 18. In this embodiment, the lower torque slot 26 is made wide enough to allow passage of the blade 38. This allows installation of different sizes of blade support assemblies 14 without removing the blades 38. Alternatively, as discussed above, the blades 38 could be installed after mounting of the blade support assembly 14 on the cutter body 12, with the pivot pins being installed and removed through the pivot pin access holes 41 provided in the blade support body 16. As can be seen, the pivot pin access holes 41 are aligned with the ends of each pivot pin 40. If the blades 38 are to be installed after mounting of the blade support assembly 14, the lower torque slots 26 and lower torque keys 22 could be narrower, as shown in FIG. 4.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A blade support assembly for mounting on a downhole casing cutter, said support assembly comprising:

a hollow blade support body coaxially disposable over a casing cutter;

at least one longitudinal blade slot through said support body, to allow passage of a cutter blade of a casing cutter;

at least one radially extending support element mounted to said support body next to said at least one longitudinal blade slot; and at least one torque transfer element on said support body, for transferring torque from a casing cutter to said support body.

2. A blade support assembly for mounting on a downhole casing cutter, said support assembly comprising:

a hollow support body;

at least one longitudinal blade slot through said support body, to allow passage of a cutter blade of a casing cutter;

at least one radially extending support element mounted to said support body next to said at least one longitudinal blade slot; and at least one torque transfer element on said support body, for transferring torque from a casing cutter to said support body;

wherein said at least one torque transfer element comprises a torque key projecting inwardly from said support body, for mating with a slot in a casing cutter.

3. A blade support assembly for mounting on a downhole casing cutter, said support assembly comprising:

a hollow support body;

at least one longitudinal blade slot through said support body, to allow passage of a cutter blade of a casing cutter;

at least one radially extending support element mounted to said support body next to said at least one longitudinal blade slot; and at least one torque transfer element on said support body, for transferring torque from a casing cutter to said support body;

wherein said at least one torque transfer element comprises a torque slot in said support body, for mating with an outwardly projecting key on a casing cutter.

4. A blade support assembly as recited in claim 1, wherein said at least one torque transfer element is an upper torque transfer element, and further comprising at least one lower torque transfer element on said support body, said at least one lower torque transfer element being longitudinally displaced from said at least one upper torque transfer element.

5. A blade support assembly for mounting on a downhole casing cutter, said support assembly comprising:

a hollow support body;

at least one longitudinal blade slot through said support body, to allow passage of a cutter blade of a casing cutter;

at least one radially extending support element mounted to said support body next to said at least one longitudinal blade slot;

at least one upper torque transfer element on said support body, for transferring torque from a casing cutter to said support body; and at least one lower torque transfer element on said support body, said at least one lower torque transfer element being longitudinally displaced from said at least one upper torque transfer element;

wherein:

said at least one upper torque transfer element comprises a torque key projecting inwardly from said support body, for mating with a slot on a casing cutter; and said at least one lower torque transfer element comprises a torque slot in said support body, for mating with an outwardly projecting key on a casing cutter.

6. A blade support assembly as recited in claim 4, wherein said blade slot is longitudinally displaced between said at least one upper torque transfer element and said at least one lower torque transfer element.

7. A blade support assembly for mounting on a downhole casing cutter, said support assembly comprising:

a hollow support body;

at least one longitudinal blade slot through said support body, to allow passage of a cutter blade of a casing cutter;

at least one radially extending support element mounted to said support body next to said at least one longitudinal blade slot; and at least one torque transfer element on said support body, for transferring torque from a casing cutter to said support body;

wherein each said radially extending support element comprises a radially extending support plate.

8. A blade support assembly as recited in claim 7, further comprising at least one annular support ring on said support body, said support ring contacting each said radially extending support plate in a torque transfer relationship.

9. A blade support assembly for mounting on a downhole casing cutter, said support assembly comprising:

a hollow tubular support body;

at least one longitudinal blade slot through said support body, to allow passage of a cutter blade of a casing cutter;

at least one radially extending longitudinal support plate mounted to said support body next to said at least one longitudinal blade slot;

at least one torque transfer key projecting inwardly from said support body, for mating with a slot in a casing cutter to transfer torque from a casing cutter to said support body, said torque transfer key being longitudinally displaced above said blade slot;

at least one torque transfer slot in said support body, for mating with an outwardly projecting key on a casing cutter to transfer torque from a casing cutter to said support body, said torque transfer slot being longitudinally displaced below said blade slot; and at least one annular support ring on said support body, said support ring contacting each said radially extending support plate in a torque transfer relationship.

10. A casing cutter assembly, comprising:

a casing cutter body adapted for attachment to a work string;

at least one casing cutter blade pivotably attached to said cutter body;

a hollow blade support body coaxially disposable over said casing cutter body;

at least one longitudinal blade slot through said blade support body, said blade slot being alignable with said casing cutter blade;

at least one radially extending support element mounted to said blade support body next to said at least one longitudinal blade slot;

a first torque transfer element on said blade support body; and a second torque transfer element on said casing cutter body, said second torque transfer element being engageable with said first torque transfer element.

11. A casing cutter assembly comprising:

a casing cutter body adapted for attachment to a work string;

at least one casing cutter blade pivotably attached to said cutter body;

a hollow blade support body coaxially disposable over said casing cutter body;

at least one longitudinal blade slot through said blade support body, said blade slot being alignable with said casing cutter blade;

at least one radially extending support element mounted to said blade support body next to said at least one longitudinal blade slot;

a first torque transfer element on said blade support body; and a second torque transfer element on said casing cutter body, said second torque transfer element being engageable with said first torque transfer element;

wherein:

said first torque transfer element comprises a torque key projecting inwardly from said blade support body; and said second torque transfer element comprises a slot in said casing cutter body.

12. A casing cutter assembly, comprising:

a casing cutter body adapted for attachment to a work string;

at least one casing cutter blade pivotably attached to said cutter body;

a hollow blade support body coaxially disposable over said casing cutter body;

at least one longitudinal blade slot through said blade support body, said blade slot being alignable with said casing cutter blade;

at least one radially extending support element mounted to said blade support body next to said at least one longitudinal blade slot;

a first torque transfer element on said blade support body; and a second torque transfer element on said casing cutter body, said second torque transfer element being engageable with said first torque transfer element;

wherein:

said first torque transfer element comprises a torque slot in said blade support body; and said second torque transfer element comprises a torque key projecting outwardly from said casing cutter body.

13. A casing cutter assembly comprising:

a casing cutter body adapted for attachment to a work string;

at least one casing cutter blade pivotably attached to said cutter body;

a hollow blade support body coaxially disposable over said casing cutter body;

at least one longitudinal blade slot through said blade support body, said blade slot being alignable with said casing cutter blade;

at least one radially extending support element mounted to said blade support body next to said at least one longitudinal blade slot;

a first upper torque transfer element on said blade support body; and a second upper torque transfer element on said casing cutter body, said second upper torque transfer element being engageable with said first upper torque transfer element; and a lower torque transfer element on said support body and a lower torque transfer element on said casing cutter body, said lower torque transfer elements being longitudinally displaced from said upper torque transfer elements.

14. A casing cutter assembly as recited in claim 13, wherein:

said upper torque transfer elements comprise a first torque key projecting inwardly from said blade support body and a first torque slot on said casing cutter body, said first torque key being engageable with said first torque slot; and said lower torque transfer elements comprise a second torque slot in said blade support body and a second torque key projecting outwardly from said casing cutter body, said second torque key being engageable with said second torque slot.

15. A casing cutter assembly as recited in claim 13, wherein said blade slot is longitudinally displaced between said upper torque transfer elements and said lower torque transfer elements.

16. A casing cutter assembly, comprising:

a casing cutter body adapted for attachment to a work string;

at least one casing cutter blade pivotably attached to said cutter body;

a hollow blade support body coaxially disposable over said casing cutter body;

at least one longitudinal blade slot through said blade support body, said blade slot being alignable with said casing cutter blade;

at least one radially extending support element mounted to said blade support body next to said at least one longitudinal blade slot;

a first torque transfer element on said blade support body; and a second torque transfer element on said casing cutter body, said second torque transfer element being engageable with said first torque transfer element;

wherein each said radially extending support element comprises a radially extending support plate.

17. A casing cutter assembly as recited in claim 16, further comprising at least one annular support ring on said blade support body, said support ring contacting each said radially extending support plate in a torque transfer relationship.

* * * * *